United States Patent [19]

Herro

[11] 3,982,336

[45] Sept. 28, 1976

[54] ATHLETIC SHOE WITH A DETACHABLE SOLE

[76] Inventor: Richard E. Herro, Rte. 5, Mound View Estates, Joliet, Ill. 60436

[22] Filed: Jan. 21, 1976

[21] Appl. No.: 650,893

[52] U.S. Cl. ..... 36/62; 36/25 R

[51] Int. Cl.[2] ..... A43C 15/00; A43B 13/00

[58] Field of Search ..... 36/62, 103, 101, 31, 36/42, 25 R

[56] References Cited

UNITED STATES PATENTS

| | | | |
|---|---|---|---|
| 1,395,958 | 11/1921 | Hamilton | 36/25 R |
| 2,873,540 | 2/1959 | Murphy | 36/101 |
| 3,012,340 | 12/1961 | Reinhart | 36/101 |

*Primary Examiner*—Patrick D. Lawson

*Attorney, Agent, or Firm*—Mason, Kolehmainen, Rathburn & Wyss

[57] ABSTRACT

An athletic shoe has a shoe portion with a sole having a number of projections extending from the sole. A detachable sole with a number of cleats or the like extending therefrom has grooves designed to mate with the projections on the sole of the shoe. Each of the projections and grooves have tapered edges such that the detachable sole will only be released from the sole of the shoe when a specified force is applied across the width of the shoe. In addition, the projections may have notches along their edges which mate with projections extending into the grooves on the detachable sole to facilitate the holding of the detachable sole on the sole of the shoe.

7 Claims, 4 Drawing Figures

ATHLETIC SHOE WITH A DETACHABLE SOLE

The present invention relates to athletic shoes, and more particularly, to a new and improved athletic shoe which has a detachable sole so that injuries to an athlete's knee can be minimized.

One athletic injury that has caused much concern in recent years is the injury to the knees of an athlete who is wearing athletic shoes with cleats extending from the sole of the shoe. Knee injuries have been of particular concern in football. Normally, a knee injury will occur when the cleats of the athletic shoe are firmly planted in the playing surface and an injurious external force is supplied to the leg of the athlete and thereby also to the athletic shoe. Such an injurious force is applied to the leg when an external force is applied to the athlete's leg from the lateral external surface of the athlete's leg toward the inner external surface of the leg of the athlete. For the purposes of this application, the lateral external surface of the athlete's leg or the outer vamp side of the shoe is the right side of the right leg or shoe and the left side of the left leg or shoe; whereas the inner external surface of the athlete's leg or the inner vamp side of the shoe is the left side of the right leg or shoe and the right side of the left leg or shoe. Moreover, although the application particularly describes the use of the shoe on the left foot of a user, a shoe for the right foot of the user can also be used along with the shoe for the left foot to protect the wearer from external forces applied to the user's legs from the lateral external surface toward the inner external surface of the user's leg.

There have been developed various athletic shoes that are designed to minimize harmful injuries to an athlete wearing a shoe. For instance, in U.S. Pat. No. 3,668,792, an athletic shoe is disclosed that has a safety sole having a plurality of cleats extending from the safety sole. The safety sole is designed to be released or to become detached from the sole of an athletic shoe whenever a transverse force (i.e., a force across the width of the shoe) is applied to the shoe. The safety sole is specifically designed to become detached when a force is applied across the shoe from either the outer vamp side or the inner vamp side of the shoe, such that a force against the lateral external surface or inner external surface of the athlete's legs would cause the detachment of the safety sole. As a result, such a safety sole would detach even during the normal course of playing a sport. This is particularly detrimental when a player is making a sharp cut or movement because a large amount of force is applied to the shoe from the inner vamp side of the shoe toward the outer vamp side of the shoe.

Accordingly, objects of the present invention are to provide a new and improved athletic shoe which lessens the likelihood of injury to the knee of the athlete; to provide a new and improved athletic shoe which has a detachable sole which releases when an injurious external force is applied to the leg of an athlete; to provide a new and improved athletic shoe that has a detachable sole which releases only when a force is applied across the shoe in the direction from the outer vamp side to the inner vamp side of the shoe; to provide a new and improved athletic shoe that has a safety sole which can be easily attached to the sole of the shoe and can released upon force being applied to the shoe from the outer vamp side of the shoe toward the inner vamp side of the shoe; and to provide a new and improved athletic shoe in which the force required to release the detachable sole can be easily adjusted during manufacturing.

In accordance with these and many other objects of the present invention, an embodiment of the present invention includes an athletic shoe having a top covering and a sole at the bottom of the covering to form a shoe. A number of prjections extend from the bottom surface of the sole, each of which projections has tapering edges converging near the outer vamp side of the shoe so that the distance between the edges is greater adjacent the inner vamp side of the shoe than adjacent the outer vamp side. The tapered edges are chamfered so as to form a flange portion along each of the tapered edges. A detachable sole having a plurality of cleats extending from the bottom surface thereof is slidably secured to the sole of the shoe by having a plurality of grooves which have tapering edges converging near the outer vamp side of the detachable sole so as to mate with the tapering projections on the sole of the shoe. The tapering edges of the grooves in the detachable sole also are chamfered to form a channel into which the flanges of the projections on the sole of the shoe are disposed when the detachable sole is mounted on the sole of the shoe. In the preferred embodiment, generally triangular shaped notches are formed along the flanges of the projections which receive triangular shaped projections extending from the tapering edges of the grooves in the detachable sole such that the amount of force required to detach the detachable sole can be adjusted.

Many other objects of the present invention will become apparent from considering the following detailed description in conjunction with the drawings in which.

Figure 1:
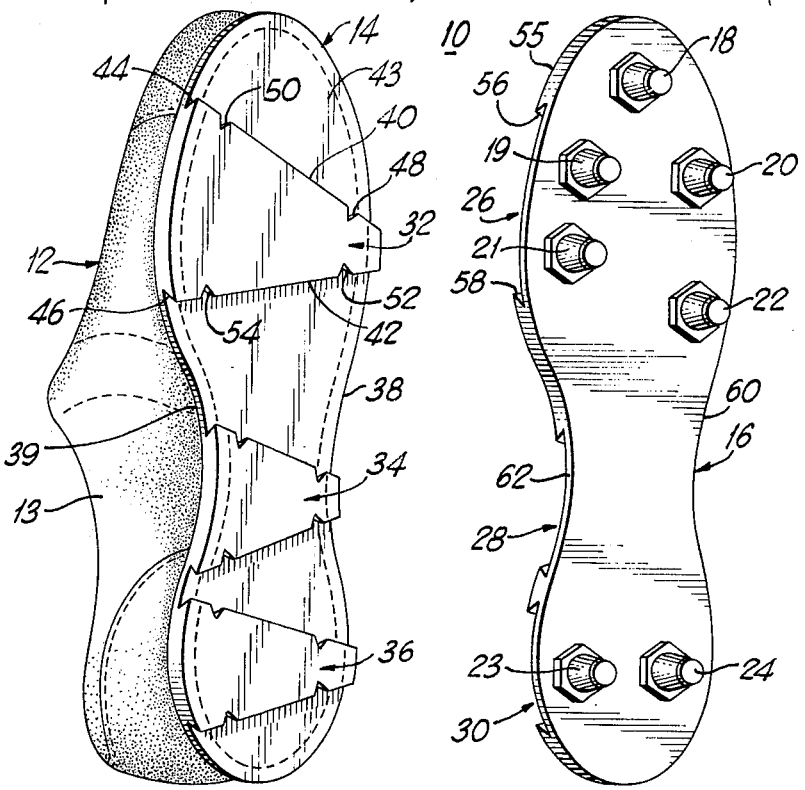
FIG. 1 is an exploded side perspective view of an athletic shoe (left shoe) embodying the present invention.
Figure 2:
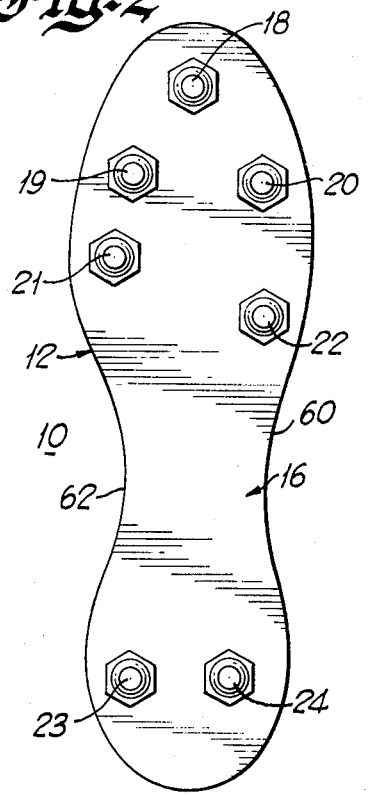
FIG. 2 is a bottom view of the athletic shoe of FIG. 2 with a detachable sole locked in place on the sole of the shoe.

Referring now more specifically to the drawings, there is disclosed an athletic shoe which is generally designated by the number 10 and which embodies the present invention. The athletic shoe 10 includes a shoe portion 12 having an upper cover 13 and a sole 14. The athletic shoe 10 is designed for the left foot of an athlete with the cover 13 and the sole 14 forming a shoe that is similar to any various types of athletic shoes now commercially available. A detachable sole 16 with cleats 18-24 extending therefrom has grooves 26, 28, and 30 which are designed to mate with projections 32, 34, and 36 extending from the bottom of the sole 14 so that the detachable sole 16 can be secured to the shoe 12.

The grooves 26, 28, and 30 and the projections 32, 34, and 36 are designed so that the detachable sole 16 will be released or detached from the sole 14 when a force is applied across the shoe 12 from an outer vamp side 38 of the shoe 12 toward the inner vamp side 39 of the shoe 12. This type of force is applied across the shoe 12 when an external injurious or harmful force is applied to the leg of the athlete, usually by the impact of another player, from the lateral external surface of the leg toward the inner external surface of the leg.

Since the detachable sole 16 will become detached or released from the sole 14 when such an injurious external force is applied to the leg of the wearer of the shoe 12, the foot of the wearer is not maintained planted to or forced against the playing surface by the cleats 18–24 and injuries to the knee of the wearer will be minimized.

Figure 3:
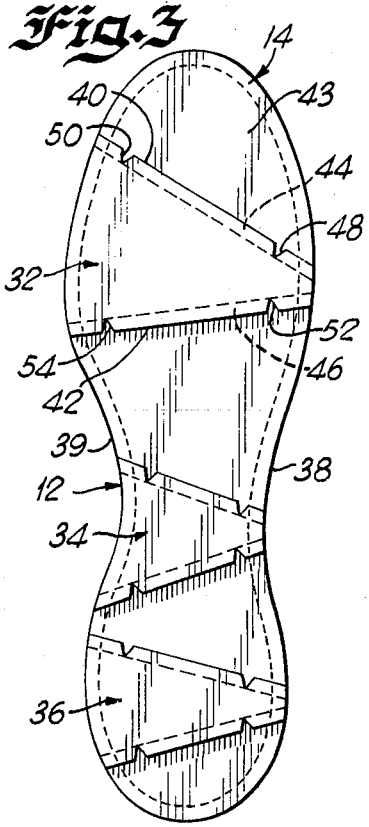
FIG. 3 is a bottom view of the athletic shoe of FIG. 1 without the detachable sole.

More specifically, the projections 32, 34, and 36 are best seen in FIGS. 1 and 3 of the drawings. As illustrated in connection with the projection 32, each of the projections 32, 34, and 36 have tapered edges 40 and 42 which extend from the outer vamp side 38 toward the inner vamp side 39 along a bottom surface 43 of the sole 14. The tapered edges 40 and 42 tend to converge near the outer vamp side 38 and diverge as they extend toward the inner vamp side 39 of the shoe 12. As best can be seen in connection with FIG. 3 of the drawings, the tapered edge 40 is somewhat chamfered to form a flange 44, and the tapered edge 42 is chamfered to form a flange 46. In addition, notches 48 and 50 are formed along the edge 40 and notches 52 and 54 are formed along the edge 42. The notches 48 and 50 are both triangular in shape with the apex of the triangles extending toward the edge 42 and the notches 52 and 54 also are triangular in shape but with the apex of the triangles extending toward the edge 40. As will be discussed in more detail hereinafter, the notches 48, 50, 52 and 54 partially determine the amount of force required to detach the detachable sole 16 from the sole 14.

Figure 4:
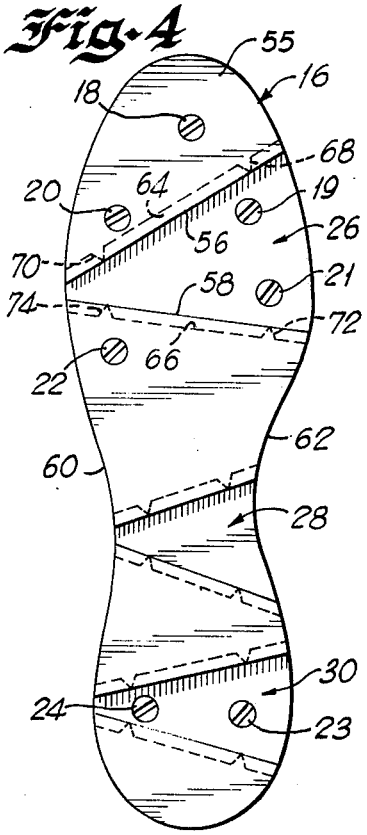
FIG. 4 is a top view of the detachable sole shown in FIG. 1.

Referring now more particularly to FIG. 4 of the drawings, the detachable sole 16 has the grooves 26, 28, and 30 formed along a top surface 55 of the sole 16 and are designed to mate with or receive the projections 32, 34, and 36, respectively, on the bottom surface 43 of the sole 14. As illustrated in connection with the groove 26, each of the grooves 26, 28 and 30 has tapered side portions 56 and 58. The side portions 56 and 58 tend to converge near an outer vamp side edge 60 of the detachable sole 16 and diverge as they extend toward an inner vamp side edge 62 of the detachable sole 16. The side portions 56 and 58 are chamfered somewhat to form channel portions 64 and 66, respectively. In addition, the side portion 56 has two triangularly shaped projections, 68 and 70, extending therefrom and the side portion 58 has has two triangular projections 72 and 74 extending therefrom. These projections 68, 70, 72, and 74 are designed to be disposed in the triangular notches 50, 48, 54 and 50, respectively.

In order to attach the detachable sole 16 to the shoe 12 and more particularly, to the bottom surface 43 of the sole 14, the detachable sole 16 is slid across the width of the shoe 12 from the outer vamp side 38 to the inner vamp side 39 of the shoe 13. In this manner, the projections 32, 34, and 36 slide into the grooves 26, 28, and 30, respectively, such that flanges 44 and 46 fit into the channel portions 64 and 66, respectively. When the detachable sole 16 is properly mated on the sole 14, the triangular projections 68, 70, 72 and 74 along the side portions 56 and 58 lodge in the notches 50, 48, 54, and 52, respectively.

As long as no force is applied across the shoe 12 from the outer vamp side 38 toward the inner vamp side 39, or in other words across the detachable sole 16 from the inner vamp side edge 62 toward the outer vamp side edge 60, the detachable sole 16 will remain disposed on the sole 14. However, as soon as an injurious external force is applied to the leg of an athlete such that a force is applied across the shoe 12 from the outer vamp side 38 toward the inner vamp side 39, the shoe 12 will become dislodged from the detachable sole 16. The amount and specific direction of the force required to dislodge the projections 32, 34 and 36 from the grooves 26, 28 and 30, respectively, and thereby the shoe 12 from the detachable sole 16, will be determined by the size and shape of the projections 68, 70, 72, 74 and the notches 50, 48, 54 and 52, and the angle at which the sides 40 and 42 diverge from each other.

More specifically, an increase in the size of the projections 68, 70, 72, and 74 and the respective notches 50, 48, 54, and 52 will require an increased amount of force to be applied to the shoe 12 before the detachable sole 16 will be dislodged or released from the sole 14. Likewise, as the angle between the sides 40 and 42 of the projection 32 decrease such that the sides 40 and 42 do not diverge from each other in any major respect, the force applied to the shoe 12 will have to be almost perpendicular to the longitudinal axis of the shoe 12 before the detachable sole 16 will be released. Accordingly, an increase in the angle between the sides 40 and 42 would allow the detachable sole 16 to be detached when a sufficient force is applied to the shoe 12 at a range of angles away from the direction perpendicular to the longitudinal axis of the shoe 12.

In one embodiment of the present invention, the angle between the sides 40 and 42 was preferably set at an angle of approximately 70°. As a result, forces applied from approximately 35° on either side of a direction perpendicular to the longitudinal axis of the sole 12 would cause the detachable sole 16 to be released. Thus, for certain athletic events or players, a larger angle would be required so that the detachable sole 16 will be released for forces in a large range of angles whereas with some players, the angle between the sides 40 and 42 will be decreased so that the force would have to be applied almost perpendicularly to the longitudinal axis of the shoe 12 before the detachable sole 16 would be released.

Alternately, an adjustable protuberance (not shown) may be extended from the sole 14 adjacent the edge 38 or the edge 39 over the side edge 62 or the side edge 60. The strength of the protuberance and the distance it extends over the edges 62 and 60 would at least partially determine the amount of force required to dislodge the detachable sole 16 from the sole 14 because the protuberances would extend into the path of movement of the detachable sole 16. Likewise, a strip of appropriate material could be disposed about the edges 38, 39, 60, and 62 of the soles 14 and 16.

Although the present invention is described with reference to a single illustrative embodiment thereof, it should be understood that numerous other modifications and embodiments of the invention can be devised by those skilled in the art that will fall within the spirit and scope of the principles of this invention.

What is claimed as new and desired to be secured by Letters Patent of the United States is:

1. A shoe having a sole and opposed elongated side edges comprising:

projection means extending between said side edges on the sole of the shoe, said projection means being tapered such that said projection means have opposed, tapered edges converging near one side edge of said shoe and;

a detachable sole with tapered groove means designed to mate with said projection means on said sole such that said detachable sole is released from said sole of said shoe only when a force is applied across said shoe from said one side edge to the other side edge.

2. The shoe as set forth in claim 1 wherein said tapered edges of said projection means are chamfered as to form flanges and the groove means are provided with channels into which said flanges are disposed when said detachable sole is mounted on said sole.

3. The shoe as set forth in claim 1 wherein said tapered edges have notches and said groove means have projections, said projections being disposed in said notch when said detachable sole is mounted on said sole.

4. A shoe having a sole and elongated side edges comprising:

a detachable sole to be mounted on the sole of said shoe, said detachable sole having corresponding side edges;

projection means on one of said soles extending between said side edges, said projection means having tapered edge portions which converge near one of said side edges; and groove means on the other of said soles having tapered edge portions such that said groove means are designed to mate with said projection means when said detachable sole is mounted on the sole of said shoe, said detachable sole being released from said sole only when a force is applied across said shoe from said one side edge toward said other of said side edges.

5. A shoe having a sole and a detachable sole, each of which soles has an inner vamp side edge and an outer vamp side edge comprising:

a plurality of projections extending from one of said soles and extending between said inner and outer vamp side edges, said projections being tapered such that said projections have side portions which converge near said outer vamp side edge; and a plurality of grooves on said other of said soles having tapered side portions which converge near said outer vamp side edge such that said projections can be disposed in said grooves, said detachable sole is released from said sole only when a force is applied across said shoe from said outer vamp side edge toward said inner vamp side edge.

6. The shoe as set forth in claim 5 wherein the angle between said side portions of said projections and said grooves is less than 70°.

7. The sole as set forth in claim 5 including means to assist in detering said detachable sole from being released from said sole.

* * * * *